US009229404B2

(12) United States Patent
Sato

(10) Patent No.: US 9,229,404 B2
(45) Date of Patent: Jan. 5, 2016

(54) IMAGE FORMING APPARATUS

(71) Applicant: CANON KABUSHIKI KAISHA, Tokyo (JP)

(72) Inventor: Hiroki Sato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/613,217

(22) Filed: Feb. 3, 2015

(65) Prior Publication Data

US 2015/0147078 A1 May 28, 2015

Related U.S. Application Data

(63) Continuation of application No. 13/867,336, filed on Apr. 22, 2013, now Pat. No. 8,995,892.

(30) Foreign Application Priority Data

Apr. 27, 2012 (JP) ..... 2012-102471

(51) Int. Cl.
*G03G 15/00* (2006.01)
*G03G 15/01* (2006.01)

(52) U.S. Cl.
CPC ..... *G03G 15/5058* (2013.01); *G03G 15/01* (2013.01); *G03G 15/0189* (2013.01); *G03G 15/50* (2013.01); *G03G 2215/0158* (2013.01)

(58) Field of Classification Search
CPC ... G03G 15/01; G03G 15/0189; G03G 15/50; G03G 15/5058; G03G 2215/0158
See application file for complete search history.

(56) References Cited

U.S. PATENT DOCUMENTS

| | | | | |
|---|---|---|---|---|
| 6,674,988 | B2 * | 1/2004 | Kawanishi | 399/301 |
| 7,689,151 | B2 * | 3/2010 | Katsuhara et al. | 399/301 |
| 8,179,569 | B2 * | 5/2012 | Kageyama et al. | 358/1.9 |
| 8,744,325 | B2 * | 6/2014 | Ino et al. | 399/301 |
| 8,811,845 | B2 * | 8/2014 | Kubota et al. | 399/72 |
| 2003/0202810 | A1 * | 10/2003 | Udaka et al. | 399/49 |
| 2004/0105689 | A1 * | 6/2004 | Shimura et al. | 399/12 |
| 2007/0110485 | A1 * | 5/2007 | Katsuhara et al. | 399/301 |
| 2009/0080915 | A1 * | 3/2009 | Hashimoto | 399/39 |
| 2009/0162112 | A1 * | 6/2009 | Murayama | 399/301 |
| 2010/0080603 | A1 * | 4/2010 | Takahashi | 399/72 |
| 2010/0172662 | A1 * | 7/2010 | Ogawa | 399/39 |
| 2011/0026982 | A1 * | 2/2011 | Murayama | 399/301 |
| 2011/0052231 | A1 * | 3/2011 | Kitao | 399/49 |
| 2011/0280633 | A1 * | 11/2011 | Ino et al. | 399/301 |
| 2012/0045234 | A1 * | 2/2012 | Suzuki et al. | 399/49 |
| 2012/0288289 | A1 * | 11/2012 | Kinoshita | 399/39 |
| 2013/0064564 | A1 * | 3/2013 | Kubota et al. | 399/72 |
| 2013/0078010 | A1 * | 3/2013 | Inoue et al. | 399/301 |

* cited by examiner

*Primary Examiner* — David Bolduc
(74) *Attorney, Agent, or Firm* — Canon USA, Inc. I.P. Division

(57) ABSTRACT

An image forming apparatus includes an image bearing member, a controller controls a first and the second image forming unit to form a measurement image on the image bearing member, wherein the measurement image is composed with a first measurement image having a first color, and a second measurement image having a second color with a lower reflectance than the first color, a radiation unit emits a irradiation light to the measurement image, a light receiving unit receives a reflected light from the measurement image, a comparison unit compares a light amount of the reflected light from the measurement image with a threshold value, and a changing unit increases the threshold value, if a measurement time period during which a light amount of the reflected light from the measurement image is equal to or greater than the threshold value is longer than a predetermined time period.

18 Claims, 11 Drawing Sheets

IMAGE FORMING APPARATUS

The present application is a Continuation of U.S. patent application Ser. No. 13/867,336 filed on Apr. 22, 2013 which claims the benefit of priority from Japanese Patent Application No. 2012-102471 filed on Apr. 27, 2012. U.S. patent application Ser. No. 13/867,336 and Japanese Patent Application No. 2012-102471, are hereby incorporated by reference herein in their entirety.

BACKGROUND OF THE INVENTION

1. Field of the Invention

The present disclosure relates to an image forming apparatus that reduces color misregistration when images of a plurality of color components are superimposed to form a color image.

2. Description of the Related Art

An image forming apparatus employing the electrophotographic process includes image forming units that form toner images of different colors for respective color components. The toner images formed by the image forming units for respective color components are transferred onto an intermediate transfer member to be superimposed. The toner images, after having been transferred onto a recording material, are fixed onto a recording material as a full-color image by heat and pressure of a fixing device.

In the image forming apparatus, when the images for the respective color components have been transferred onto the intermediate transfer member, if there is a positional deviation between the images for the respective color components, color misregistration will be produced in an image on the recording material. Therefore, an image forming apparatus discussed in U.S. Patent Publication No. 2011/0280633A1, forms a measurement image for color misregistration detection on an intermediate transfer member, and adjusts a position and a timing at which the image is formed for each image forming unit, based on a result of detection of the measurement image for color misregistration detection.

In the image forming apparatus discussed in U.S. Patent Publication No. 2011/0280633A1, a first image forming unit forms a first measurement image having a first color onto the intermediate transfer member, and a second image forming unit forms a second measurement image having a second color at a position on the intermediate transfer member away from the first measurement image by a predetermined distance. The first measurement image and the second measurement image on the intermediate transfer member pass through a measurement position, and thereby a positional difference between the first measurement image and the second measurement image is detected. The measurement position is a position on the intermediate transfer member at which an optical sensor radiates light. In U.S. Patent Publication No. 2011/0280633A1, a position at which the second image having the second color is formed by the second image forming unit is adjusted based on the positional difference thereof. Accordingly, color misregistration of an image, which is formed by transferring the second image having the second color to be superimposed on the first image having the first color, is reduced.

The optical sensor outputs a signal determined according to an amount of received light, by receiving the light reflected by the intermediate transfer member or the measurement image for color misregistration detection. The positional difference is determined according to a time difference between a time period during which an output value when the optical sensor has received a reflected light from the first measurement image exceeds a threshold value, and a time period during which an output value when the optical sensor has received a reflected light from the second measurement image exceeds the threshold value.

Further, an achromatic color toner and the intermediate transfer member have a low reflectance, and their difference is small. Therefore, a position of an image formed with the achromatic color toner on the intermediate transfer member cannot be detected by the optical sensor. Thus, in U.S. Patent Publication No. 2011/0280633A1, a position of the image formed with the achromatic color toner on the intermediate transfer member is detected using a composite pattern. The composite pattern is images obtained by transferring a plurality of images formed with the achromatic color toner separated from each other by a predetermined distance, on an image formed with chromatic color toner. In other words, the composite pattern is a pattern in which an image region formed with the chromatic color toner is exposed from a region between a plurality of images formed with achromatic color toner. The optical sensor can detect a reflected light from the image region formed with the chromatic color toner exposed from the region between the plurality of images formed with the achromatic color toner.

FIG. 11 is a schematic diagram illustrating a reference pattern and a composite pattern formed on the intermediate transfer member in a case where a positional deviation has not occurred, and a reference pattern and a composite pattern formed on the intermediate transfer member in a case where a positional deviation has occurred. The reference pattern is a first measurement image having a magenta toner. The composite pattern is formed by superimposing the second measurement image having a black toner on the first measurement image having the magenta toner Further, a distance Lo between the reference pattern and the magenta image that constitutes the composite pattern does not cause an error, since the magenta image is formed by the same image forming unit for magenta.

In a case where the image formed with the magenta toner and the image formed with the black toner do not have a positional deviation, a positional difference from the reference pattern to the magenta image region exposed from a region between the plurality of images formed with the black toner becomes Lma (target distance). On the other hand, in a case where the image formed with the magenta toner and the image formed with the black toner have a positional deviation, a positional difference from the reference pattern to the magenta image region exposed from the region between the plurality of images formed with the black toner becomes Lmb. In other words, in a case where the image formed with the black toner has a positional deviation, a positional difference Lmb from the reference pattern to the magenta image region exposed from the region between the plurality of images formed with the black toner differs by a positional deviation amount $\Delta L$ relative to the target distance Lma. The image forming apparatus discussed in U.S. Patent Publication No. 2011/0280633A1 adjusts a position at which the black image is formed based on the positional deviation amount $\Delta L$, thereby reducing color misregistration of an image formed by transferring the black image overlapping the magenta image.

However, in the composite pattern composed of the chromatic color toner and the achromatic color toner, an amount of the achromatic color toner overlapped on a region formed with the chromatic color toner may be decreased by an influence of temperature or humidity. When an amount of the achromatic color toner overlapped on a region formed with the chromatic color toner decreases, light radiated from the optical sensor penetrates through the achromatic color toner region and is reflected from the chromatic color toner region, thereby increasing an amount of light received by the optical sensor.

As a result, if an output value output from the optical sensor becomes a threshold value or greater, by the optical sensor receiving the reflected light from the chromatic color toner covered by the achromatic color toner, there is a problem that a positional difference between the reference pattern and the composite pattern may be erroneously detected. Consequently, even if a position at which an image is to be formed is adjusted, based on a positional difference between the reference pattern and the composite pattern formed on the intermediate transfer member, there is a problem that color misregistration of an image formed by superimposing the image formed the achromatic color toner on the image formed with the chromatic color toner cannot be inhibited

SUMMARY OF THE INVENTION

An embodiment of the present invention is directed to an image forming apparatus capable of reducing color misregistration, even when a toner amount of a toner image formed using an achromatic color toner contained in a composite pattern decreases.

According to an aspect of the present invention, an image forming apparatus includes an image bearing member configured to be conveyed in a predetermined direction, a first image forming unit configured to form a first image having a first color on the image bearing member, a second image forming unit configured to form a second image having a second color with a lower reflectance than the first color on the image bearing member, a controller configured to control the first image forming unit and the second image forming unit to form a measurement image on the image bearing member when a measurement mode is performed, wherein the measurement image is composed with (i) a first measurement image having the first color and (ii) a second measurement image, in which a predetermined a predetermined gap in the predetermined direction, having the second color, wherein the second measurement image is superimposed on the first measurement image such that the first measurement image appears in the predetermined gap of the second measurement image, a radiation unit configured to emit a irradiation light to the image bearing member, a light receiving unit configured to receive a reflected light from the measurement image formed on the image bearing member, a comparison unit configured to compare a light amount of the reflected light from the measurement image received by the light receiving with a threshold value, and a changing unit configured to increase the threshold value, if a measurement time period during which a light amount of the reflected light from the measurement image received by the light receiving unit is equal to or greater than the threshold value is longer than a predetermined time period according to the predetermined gap.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
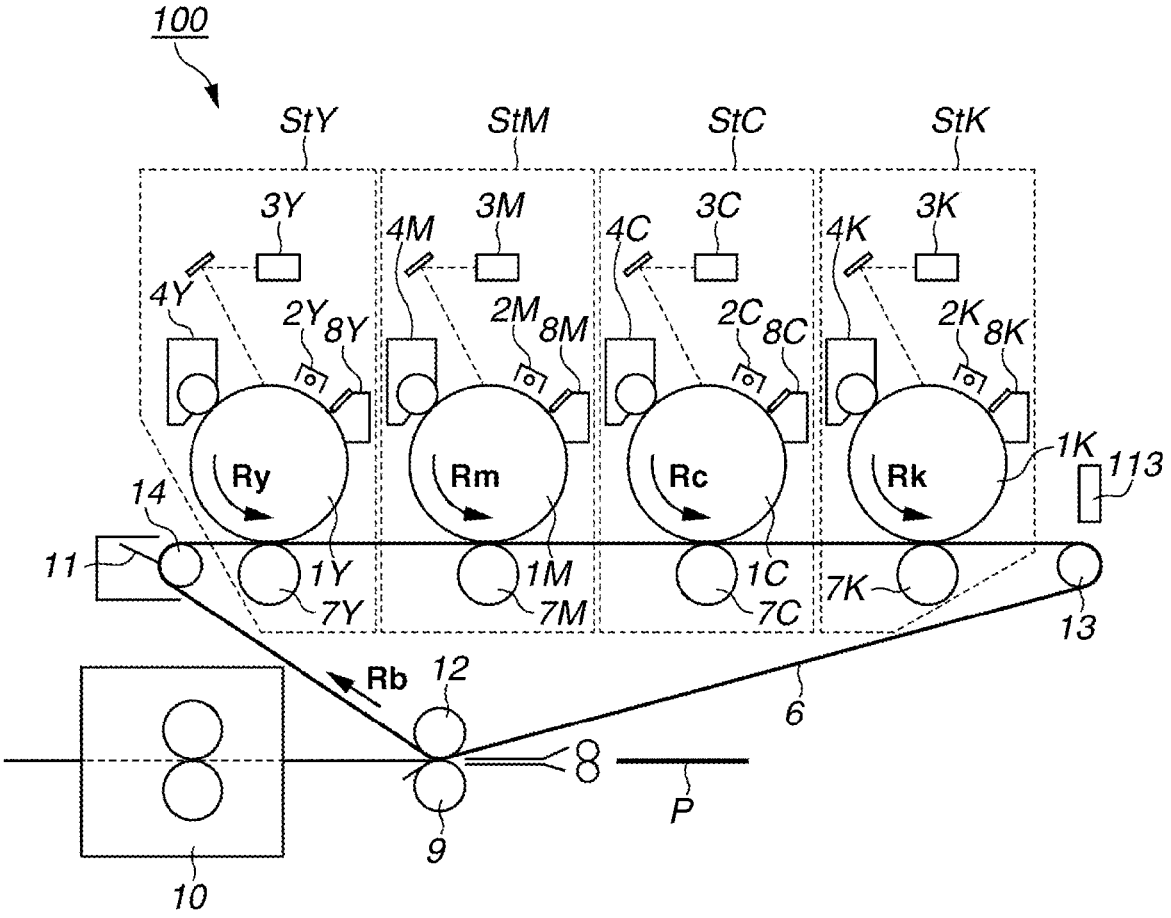
FIG. 1 is a diagram illustrating an image forming apparatus.

FIG. 1 is a schematic cross-sectional view of an image forming apparatus 100 according to a first exemplary embodiment. In the present exemplary embodiment, there is employed an image forming apparatus in which four image forming units StY, StM, StC, and StK for forming toner images of respective color components are arrayed in a row.

Each of the image forming units forms a toner image of each color, that is, StY forms a yellow toner image, StM forms a magenta toner image, StC forms a cyan toner image, and StK forms a black toner image.

The respective image forming units StY, StM, StC, and StK have the similar configuration, and therefore the image forming unit StY that forms yellow toner image will be described hereinbelow, and descriptions of other image forming units StM, StC, and StK will not be repeated.

The image forming unit StY includes a photosensitive drum 1Y that bears a toner image of the color component of yellow, a charging device 2Y that charges the photosensitive drum 1Y, and an exposure device 3Y that exposes the photosensitive drum 1Y with light, in order to form an electrostatic latent image corresponding to the color component of yellow on the photosensitive drum 1Y. Furthermore, the image forming unit StY includes a development device 4Y that develops an electrostatic latent image formed on the photosensitive drum 1Y with toner, and a primary transfer roller 7Y that transfers the toner image borne on the photosensitive drum 1Y onto the intermediate transfer belt 6 described below. Also, the image forming unit StY includes a drum cleaner 8Y that removes toner left on the photosensitive drum 1Y, after transferring the toner image. In an embodiment of the present invention the intermediated transfer belt is an endless belt.

The intermediate transfer belt 6 described above is an image bearing member that bears a full-color toner image by transferring the toner images of the respective color components formed in a superimposed manner by the respective image forming units StY, StM, StC, and StK. Further, the intermediate transfer belt 6 is stretched around a driving roller 13 that drives and rotates the intermediate transfer belt 6, and a driven roller 14 and a roller 12 that are driven and rotated by the intermediate transfer belt 6 moved in a conveying direction Rb by the driving roller 13. In the neighborhood of the intermediate transfer belt 6, a secondary transfer roller 9 for transferring a toner image on the intermediate transfer belt 6 onto a recording material P such as paper is disposed at a position facing the roller 12 via the intermediate transfer belt 6. Furthermore, a belt cleaner 11 for removing toner left without being transferred from the intermediate transfer belt 6 to the recording material P is disposed.

Further, an optical sensor 113 is disposed at a position facing the driving roller 13 via the intermediate transfer belt 6. The optical sensor 113 outputs a signal corresponding to an amount of reflected light from the toner image formed on the intermediate transfer belt 6. The details of the optical sensor 113 will be described below. The image forming apparatus 100 is provided with a fixing device 10 that fixes the toner image on the recording material P that bears the toner image.

Next, an image forming operation performed by the image forming apparatus 100 according to the present exemplary embodiment for forming an image corresponding to image data input by reading an original document by a reading device (not illustrated), or image data transferred from a personal computer (PC) or the like will be described.

In the respective image forming units StY, StM, StC, and StK, first, the charging devices 2Y, 2M, 2C, and 2K uniformly charge the photosensitive drums 1Y, 1M, 1C, and 1K, respectively. Then, the exposure devices 3Y, 3M, 3C, and 3K radiate exposure lights corresponding to values of densities of the respective color components onto the respective photosensitive drums 1Y, 1M, 1C, and 1K, thereby forming electrostatic latent images of the image data for respective color components. Thereafter, the electrostatic latent images on the photosensitive drums 1Y, 1M, 1C, and 1K are visualized as the toner images of the respective color components by the development devices 4Y, 4M, 4C, and 4K.

The toner images of the respective color components on the photosensitive drums 1Y, 1M, 1C, and 1K are conveyed to primary transfer nip portions along with rotations of the photosensitive drums 1Y, 1M, 1C, and 1K. In this process, the primary transfer nip portions are regions where the intermediate transfer belt 6 contacts the photosensitive drums 1Y, 1M, 1C, and 1K. In the primary transfer nip portions, primary transfer voltages are applied to the toner images of the respective color components on the photosensitive drums 1Y, 1M, 1C, and 1K from the primary transfer rollers 7Y, 7M, 7C, and 7K, and the toner images are sequentially transferred onto the intermediate transfer belt 6 in a superimposed manner. Accordingly, a full-color toner image is formed on the intermediate transfer belt 6. Further, the toners left on the photosensitive drums 1Y, 1M, 1C, and 1K are removed by drum cleaners 8Y, 8M, 8C, and 8K.

The full-color toner image transferred onto the intermediate transfer belt 6 is conveyed to a secondary transfer nip portion. The secondary transfer nip portion is a region where the secondary transfer roller 9 contacts the intermediate transfer belt 6. On the other hand, when the recording material P is conveyed to the secondary transfer nip portion with a timing being adjusted so that the recording material P contacts the full-color toner image on the intermediate transfer belt 6, the toner image on the intermediate transfer belt 6 is transferred onto the recording material P, by the secondary transfer roller 9 to which a secondary transfer voltage has been applied. Further, the toner left on the intermediate transfer belt 6 without being transferred onto the recording material P at the secondary transfer nip portion is removed by the belt cleaner 11.

The recording material P which bears the toner image is conveyed to the fixing device 10. The fixing device 10, by applying heat and pressure to the recording material which bears the unfixed toner image, fixes the unfixed toner image.

Now, relative positional deviation (color misregistration) occurred between the toner images of respective colors transferred onto the intermediate transfer belt 6 by the respective image forming units StY, StM, StC, and StK will be described. The image forming units StY, StM, StC, and StK form images of the respective color components on the photosensitive drums 1Y, 1M, 1C, and 1K, based on a result of reading out a document, and once transfer the images of the respective color components onto the intermediate transfer belt 6 in a superimposed manner, to form a full-color image thereon. The full-color image formed on the intermediate transfer belt 6 is transferred onto the recording material P, and is fixed on the recording material P by the fixing device 10. At that time, when relative positional deviation occurs in the images transferred onto the intermediate transfer belt 6 in a superimposed manner, color tones differ between the original document and the image formed on the recording material.

Thus, in the image forming apparatus 100, after a power source has been turned on, or after images for a predetermined number of pages have been formed, color misregistration correction control for correcting relative positional deviation of the images formed on the intermediate transfer belt 6 is executed.

When the color misregistration correction control is executed, the image forming apparatus 100 forms latent images corresponding to the toner images (hereinafter, measurement images for color misregistration detection) for measuring positions at which the images of the respective color components are transferred, by the exposure devices 3Y, 3M, 3C, and 3K exposing the photosensitive drums 1Y, 1M, 1C, and 1K with lights. When the electrostatic latent images visualized by the development devices 4Y, 4M, 4C, and 4K, the visualized measurement images for color misregistration detection are transferred onto the intermediate transfer belt 6 by the primary transfer rollers 7Y, 7M, 7C, and 7K. The measurement images formed on the intermediate transfer belt 6 are detected by the optical sensor 113 described above.

Figure 2:
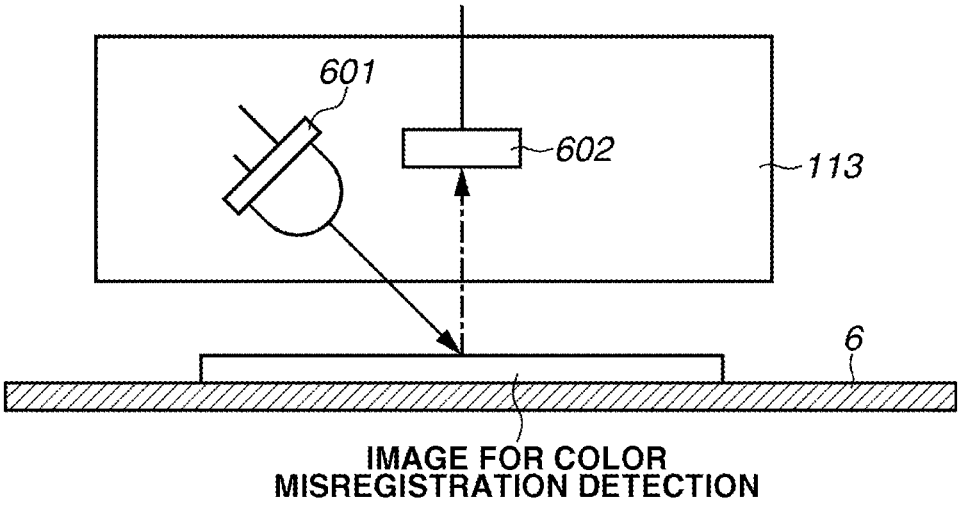
FIG. 2 is a diagram illustrating an optical sensor.

FIG. 2 is a schematic diagram of the optical sensor 113. The optical sensor 113 is provided with a light emitting unit 601 that radiates light toward the intermediate transfer belt 6 or the measurement images, and a light receiving unit 602 that receives a reflected light from the intermediate transfer belt 6, or the measurement image. The light receiving unit 602 is arranged at a position at which an incident angle and a reflection angle do not become equal to each other, so that diffusely reflected light of the light radiated from the light emitting unit 601 toward the intermediate transfer belt 6 can be received. The light receiving unit 602, upon receiving the light reflected from the intermediate transfer belt 6, or the light reflected from the measurement image formed on the intermediate transfer belt 6, outputs a signal at a level according to an amount of light received.

Figure 3:
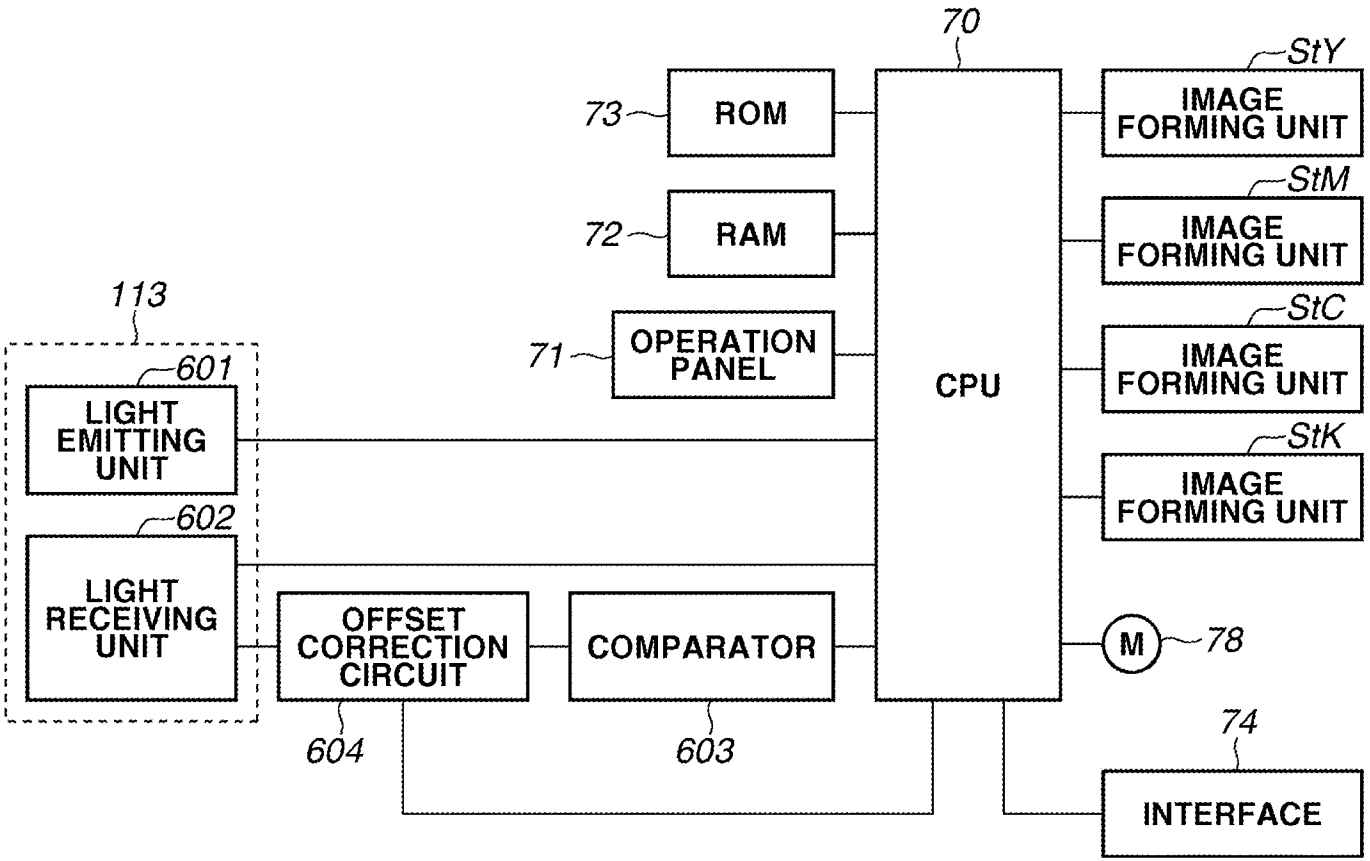
FIG. 3 is a control block diagram of the image forming apparatus.

FIG. 3 is a control block diagram of the image forming apparatus 100 according to the present exemplary embodiment.

In FIG. 3, a central processing unit (CPU) 70 is a control circuit that controls the image forming apparatus 100. A read only memory (ROM) 73 stores therein a control program executed by the CPU 70 for controlling an operation of the image forming apparatus 100. A random access memory (RAM) 72 is a system work memory used in the color misregistration correction control executed by the CPU 70.

An operation panel 71 includes a touch panel and a ten key (not illustrated) disposed in the image forming apparatus 100 illustrated in FIG. 1, and is used to directly input various conditions for image formation by a user.

An interface 74 transfers image data input from an external apparatus such as a PC to the CPU 70.

The image forming units StY, StM, StC, and StK have been described referring to FIG. 1, and therefore descriptions thereof will not be repeated. Further, a motor 78 is a motor for driving and rotating the driving roller 13, and when a signal for starting to drive and rotate the intermediate transfer belt 6 is input from the CPU 70, rotates the driving roller 13 at a predetermined rotating speed.

The light emitting unit 601 radiates measurement light onto the intermediate transfer belt 6 in response to a signal from the CPU 70. The light emitting unit 601 works as a irradiation unit that radiates light toward the intermediate transfer belt 6. The light receiving unit 602 outputs a voltage determined according to an amount of the received light to the CPU 70 and an offset correction circuit 604, respectively.

The offset correction circuit 604 outputs a voltage of difference between a voltage output from the light receiving unit 602 and a setting voltage to a comparator 603. The setting voltage is set by the CPU 70. Accordingly, a voltage input into the comparator 603 is offset by the amount of the setting voltage.

The comparator 603, if an input voltage is equal to or higher than a threshold value, outputs a low level signal to the CPU 70, and if an input voltage is lower than a threshold value, outputs a high level signal to the CPU 70. That is, the comparator 603 converts an analog signal (voltage) output from the light receiving unit 602 via an offset correction circuit into a binary digital signal.

Figure 8:
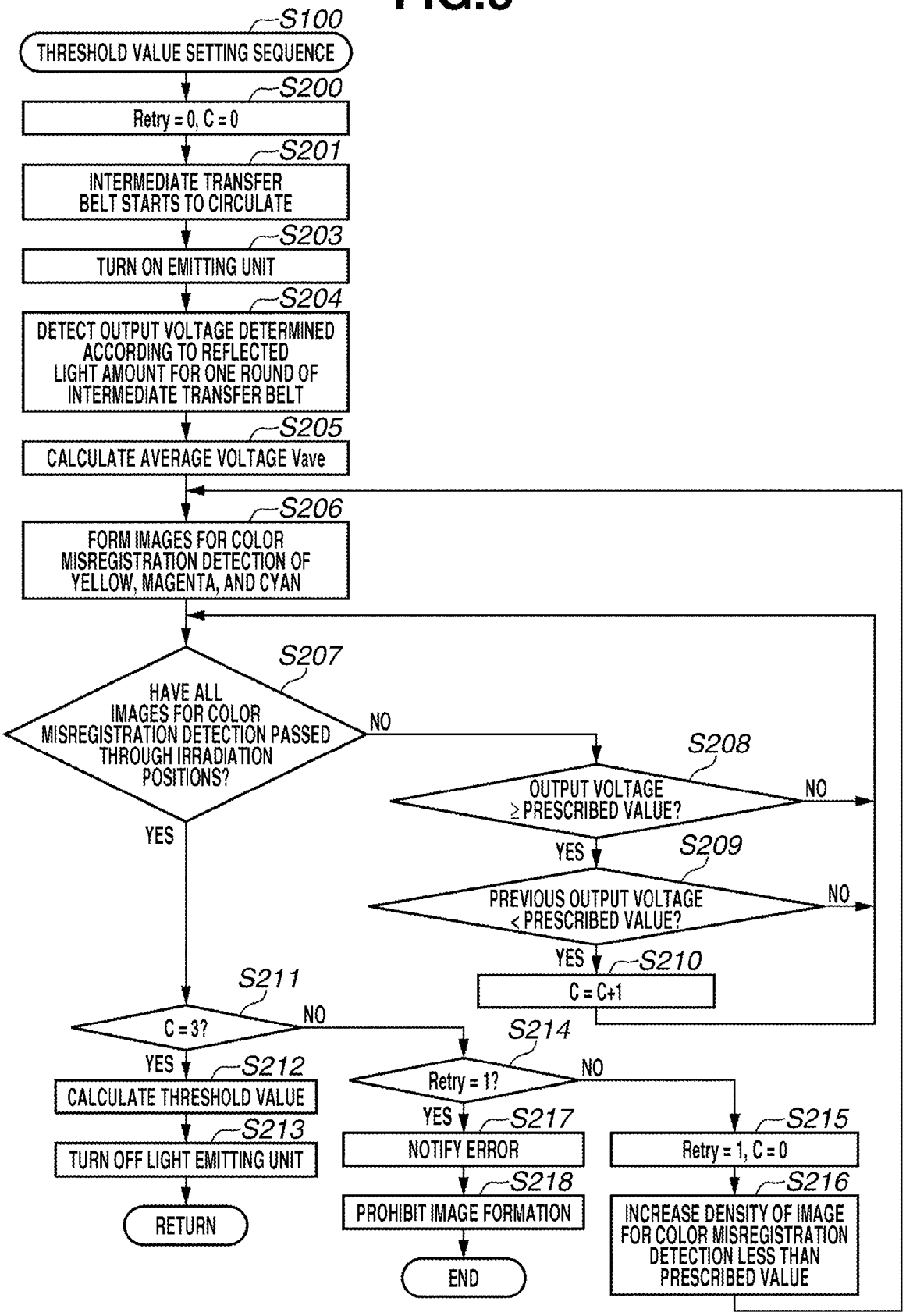
FIG. 8 is a flowchart illustrating a threshold value correction sequence.

The CPU 70, by detecting positions of the measurement images based on the output signals from the comparator 603, controls positions at which the image forming units StY, StM, StC, and StK form the images on the photosensitive drums 1Y, 1M, 1C, and 1K. Accordingly, the CPU 70 reduces color misregistration, in a case where the images of the respective color components are overlapped on the intermediate transfer belt 6. Further, the CPU 70 sets a threshold value of the comparator 603 based on a voltage value output from the light receiving unit 602, by executing a threshold value setting sequence (FIG. 8).

Figure 4:
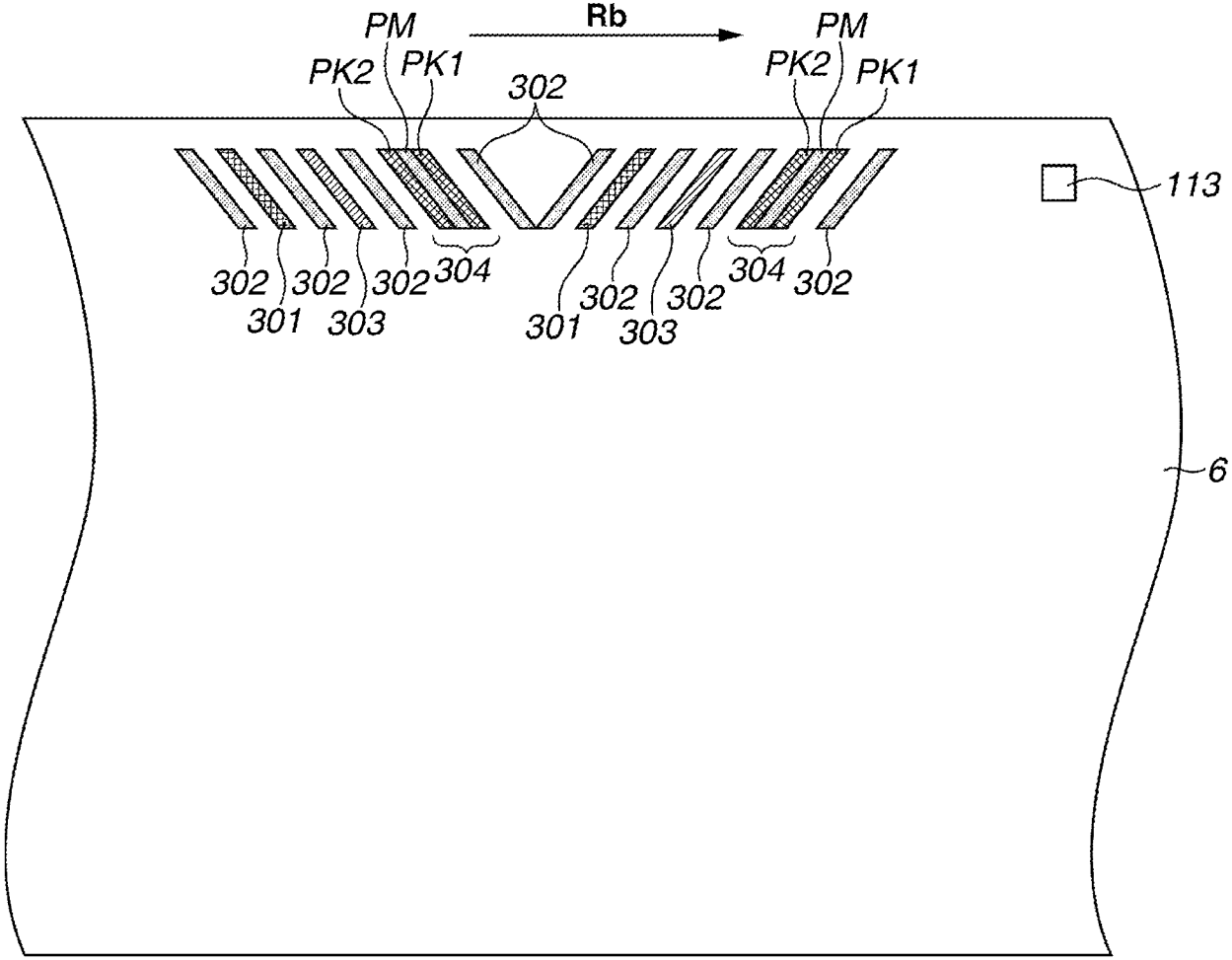
FIG. 4 is a diagram illustrating measurement images for color misregistration detection.

FIG. 4 is a schematic diagram of the measurement images formed on the intermediate transfer belt 6 by the image forming units StY, StM, StC, and StK. On the intermediate transfer belt 6, four kinds of measurement images are formed, i.e., a measurement image 301 of yellow, a measurement image 302 of magenta, a measurement image 303 of cyan, and a composite measurement image 304 composed of a first measurement image PM having a magenta and second measurement images PK1 and PK2 having a black. The measurement images 301, 302, and 303, and the composite measurement image 304 are composed of patterns having a longitudinal direction inclined 45° relative to the conveying direction Rb of the intermediate transfer belt 6, and patterns having a longitudinal direction inclined 135° relative to the conveying direction Rb of the intermediate transfer belt 6.

The measurement images 301, 302, and 303 are formed with a width of cross-section in the conveying direction Rb of the intermediate transfer belt 6 being 1.2 mm, and with a width from one end portion to the other end portion in a direction orthogonal to the conveying direction Rb being 4.2 mm.

Further, the composite measurement image 304 is formed by transferring the second measurement images PK1 and PK2 onto the first measurement image PM with a gap of 1.2 mm in a superimposed manner. The first measurement image PM is formed with a width of cross-section in the conveying direction Rb being 4.7 mm, and a width from one end portion to the other end portion in a direction orthogonal to the conveying direction Rb being 4.2 mm. Each of the second measurement images PK1 and PK2 is formed with a width of 3.5 mm in a direction parallel with the conveying direction Rb, and a width of 4.2 mm in a direction orthogonal to the conveying direction Rb. The composite measurement image 304 corresponds to a measurement image.

In the color misregistration correction control, the CPU 70 adjusts forming positions of the measurement images of the respective color components using a position at which the magenta measurement image is formed as the reference. In other words, the CPU 70 controls positions where the measurement images of the respective color components are to be formed, according to a result of having detected relative positional relation between the measurement images 301 and 303, and the composite measurement image 304. The image forming unit StM works as a first image forming unit that forms a magenta image corresponding to an image having the first color. Furthermore, the image forming unit StK works as a second image forming unit that forms a black image corresponding to an image having the second color.

A method for calculating a positional difference (hereinafter, referred to as an amount of positional deviation) of a forming position of the measurement image 301 of yellow relative to a forming position of the measurement image 302 of magenta will be described with reference to FIGS. 5A to 5C.

Figure 5A:
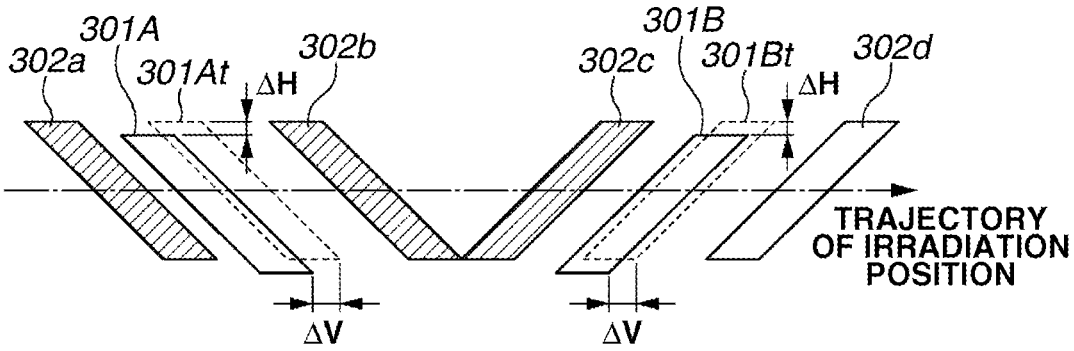
FIGS. 5A to 5C are diagrams illustrating an output result when measurement images for color misregistration detection are detected by an optical sensor.

FIG. 5A illustrates measurement images 302*a*, 302*b*, 302*c*, and 302*d* of magenta formed on the intermediate transfer belt, and measurement images 301A and 301B of yellow. The measurement image 301A is formed between the measurement images 302*a* and 302*b* of magenta, and the measurement image 301B of yellow is formed between the measurement images 302*a* and 302*b* of magenta. Alternate long and short dash line in FIG. 5A indicates a trajectory of a position (radiation position) at which light is radiated by the light emitting unit 601 of the optical sensor 113, on the intermediate transfer belt 6. Broken lines 301At and 301Bt are target positions at which the measurement images 301A and 301B of yellow are to be formed, in a case where forming positions of the yellow images are not deviated relative to forming positions of the magenta images.

Figure 5B:
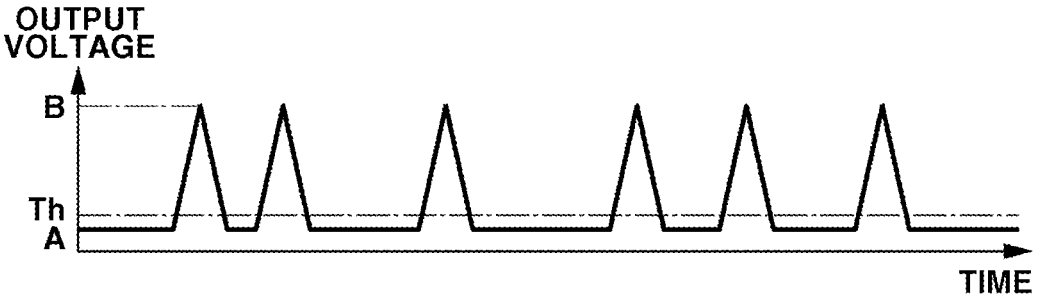

FIG. 5B illustrates waveforms of voltages output from the light receiving unit 602 of the optical sensor 113, by driving the intermediate transfer belt 6 in the conveying direction Rb, in a state where the light emitting unit 601 of the optical sensor 113 radiates light on the intermediate transfer belt 6. In a case where the measurement images 302*a*, 301A, 302*b*, 302*c*, 301B, and 302*d* has not yet reached the radiation position of the light emitting unit 601 of the optical sensor 113, the light receiving unit 602 of the optical sensor 113 receives diffusely reflected light from the intermediate transfer belt 6. At that time, the light receiving unit 602 outputs a voltage of A volts determined according to an amount of reflected light from the intermediate transfer belt 6. On the other hand, when the measurement images 302*a*, 301A, 302*b*, 302*c*, 301B, and 302*d* passes through the radiation position, the light receiving unit 602 of the optical sensor 113 receives diffusely reflected lights from the measurement images 302*a*, 301A, 302*b*, 302*c*, 301B, and 302*d*. At that time, voltages output from the light receiving unit 602 are increased according to amounts of reflected lights from the measurement images 302*a*, 301A, 302*b*, 302*c*, 301B, and 302*d*. This is because amounts of diffusely reflected lights from the measurement images 302*a*, 301A, 302*b*, 302*c*, 301B, and 302*d* are larger than an amount of diffusely reflected light from the intermediate transfer belt 6. A voltage output from the light receiving unit 602 is increased to B volts at maximum.

Figure 5C:
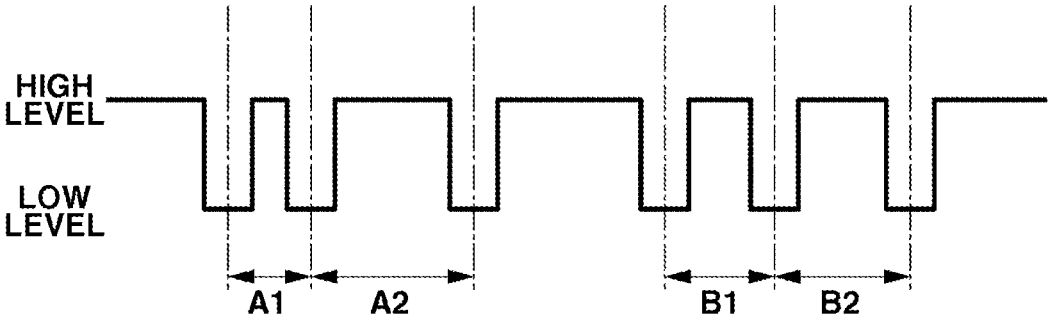

FIG. 5C is a diagram illustrating binary digital signals output from the comparator 603 determined according to voltages output from the light receiving unit 602. If an output voltage of the light receiving unit 602 is equal to or higher than a threshold value Th indicated in FIG. 5B, the comparator 603 outputs a low level signal. If an output voltage of the light receiving unit 602 is lower than the threshold value Th, the comparator 603 outputs a high level signal. The CPU 70 detects a center position between a timing when a digital signal output from the comparator 603 is switched from the high level to the low level, and a timing when it is switched from the low level to the high level, as a forming position of the measurement image. Therefore, the forming positions of the measurement images 302*a*, 301A, 302*b*, 302*c*, 301B, and 302*d* become A1, A2, B1, and B2, as illustrated in FIG. 5C. If a positional deviation amount in a direction orthogonal to the conveying direction Rb is ΔV, and a positional deviation amount in the conveying direction Rb is ΔH, the positional deviation amounts ΔV and ΔH can be calculated by the following equations.

$$\Delta V=\{(B2-B1)/2-(A2-A1)/2\}/2 \quad \text{(Equation 1)}$$

$$\Delta H=\{(B2-B1)/2+(A2-A1)/2\}/2 \quad \text{(Equation 2)}$$

Next, an output voltage when the light receiving unit 602 of the optical sensor 113 receives a diffusely reflected light from the composite measurement image 304 for color misregistration detection, and a digital signal output from the comparator 603 according to the output voltage will be described with reference to FIGS. 6A to 6C. In the description below, it is assumed that an image forming position of black relative to an image forming position of magenta is deviated on a downstream side of the conveying direction Rb.

Figure 6A:
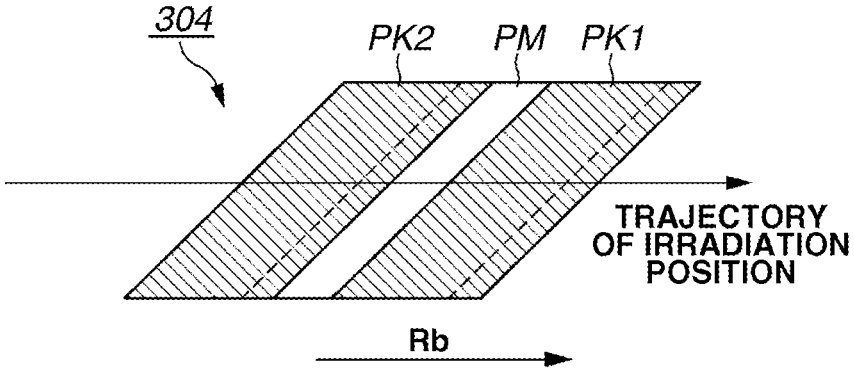
FIG. 6A to 6C are diagrams illustrating an output result when a composite measurement image for color misregistration detection is detected by the optical sensor.

FIG. 6A is the composite measurement image 304 for color misregistration detection formed on the intermediate transfer belt 6. The composite measurement image 304 for color misregistration detection is formed by transferring the black images PK1 and PK2 formed by the image forming unit StK on the magenta image PM formed by the image forming unit StM in a superimposed manner.

Figure 6B:
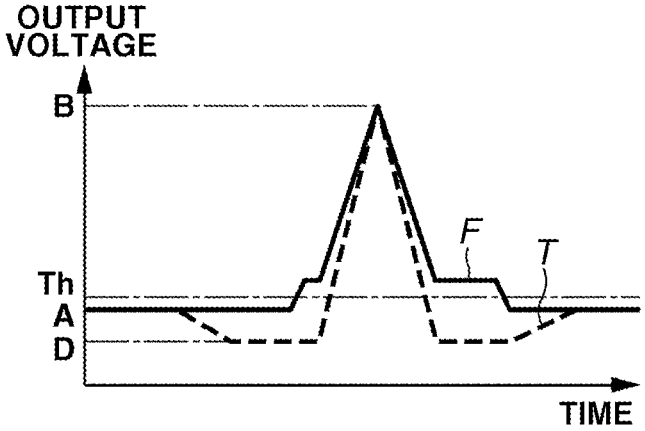

FIG. 6B illustrates a waveform of voltage output from the light receiving unit 602 of the optical sensor 113 when the intermediate transfer belt 6 is driven in the conveying direction Rb, in a state where the light emitting unit 601 of the optical sensor 113 radiates light on the intermediate transfer belt 6.

First, an output value when a composite measurement pattern formed in a state where black toner is not deteriorated is detected using the optical sensor 113 will be described. A broken line T indicates an output voltage waveform in a case where the composite measurement pattern is formed in a state where the black toner is not deteriorated. The target value corresponds to a light amount received by the light receiving unit 602 when a voltage output from the light receiving unit 602 becomes equal to the threshold value Th.

In a state where the light emitting unit 601 of the optical sensor 113 radiates light onto the intermediate transfer belt 6 when the intermediate transfer belt 6 is driven in the conveying direction Rb, first, the black image PK1 of the composite the measurement image 304 for color misregistration detection reaches a radiation position. At that time, a greater part of the light radiated from the light emitting unit 601 is absorbed by the second measurement image PK1 having the black toner, and the voltage output from the light receiving unit 602 gradually decreases, and drops down to D volts.

Then, when the magenta image PM exposed from between the black images PK1 and PK2 of the composite measurement image 304 for color misregistration detection reaches the radiation position, the light receiving unit 602 start receiving diffusely reflected light from the first measurement image PM having the magenta. Since an amount of light diffusely reflected by the first measurement image PM is larger than an amount of light diffusely reflected light by the second measurement images PK1 and PK2, the voltage output from the light receiving unit 602 increases. When all of the light received by the light receiving unit 602 become diffusely reflected light from the first measurement image PM, the voltage output from the light receiving unit 602 becomes equal to B volts.

Then, when the second measurement image PK2 of the composite measurement image 304 reaches the radiation position, a greater part of the light radiated from the light emitting unit 601 is absorbed by the second measurement image PK1. Accordingly, while the second measurement image PK2 passes through the radiation position, the voltage output from the light receiving unit 602 gradually decreases, and drops down to D volts. Thereafter, when the light receiving unit 602 starts receiving diffusely reflected light from the intermediate transfer belt 6, a voltage output from the light receiving unit 602 gradually increases. When all the light received by the light receiving unit 602 becomes diffusely reflected light from the intermediate transfer belt 6, the voltage output from the light receiving unit 602 becomes equal to A volt.

Next, an output value when a composite measurement pattern formed in a state where black toner is deteriorated has been detected using the optical sensor 113 will be described. A solid line F indicates an output voltage waveform in a case where the composite measurement pattern is formed while black toner is in a deteriorated condition. When the black toner has been deteriorated, an electric charge amount of the black toner becomes higher than a targeted charge amount, and an amount of toner applied to the measurement images formed as the second measurement images PK1 and PK2 constituting the composite measurement pattern will decrease. In other words, the composite measurement pattern formed in the state where the black toner is deteriorated is such that the light radiated from the light emitting unit 601 is not absorbed by the second measurement images PK1 and PK2, but is reflected by the first measurement image PM positioned under the second measurement images PK1 and PK2. Accordingly, despite the fact that the second measurement images PK1 and PK2 of the composite measurement pattern are positioned at the radiation position, an amount of light received by the light receiving unit 602 increases, and a voltage output from the light receiving unit 602 becomes equal to or greater than the threshold value Th.

When the intermediate transfer belt 6 is driven in the conveying direction Rb in a state where the light-emitting unit 601 of the optical sensor 113 radiates light onto the intermediate transfer belt 6, first, the second measurement image PK1 of the composite measurement image 304 reaches the radiation position. In a case where an amount of diffuse reflected light from the second measurement image received by the light receiving unit 602 is less than the threshold value Th, light radiated from the light emitting unit 601 transmits through the second measurement image PK1 and is reflected by the intermediate transfer belt 6. At that time, a voltage output from the light receiving unit 602 remains equal to A volts.

Then, when a region of the first measurement image PM on which the second measurement image PK1 is superimposed reaches the radiation position, a part of light radiated from the light emitting unit 601 is absorbed by the second measurement image PK1, and a part thereof is reflected diffusely by a region of the first measurement image PM on which the second measurement image PK1 is superimposed. When the light receiving unit 602 receives light reflected diffusely from a region of the first measurement image PM on which the second measurement image PK1 is superimposed, a voltage to be output from the light receiving unit 602 increases to a value equal to or greater than the threshold value Th volts.

Then, when a region of the first measurement image PM on which the second measurement images PK1 and PK2 are not superimposed reaches the radiation position, the light receiving unit 602 receives diffusely reflected light from the first measurement image PM. Accordingly, while a region of the first measurement image PM on which the second measurement images PK1 and PK2 are not superimposed passes through the radiation position, a voltage output from the light receiving unit 602 continues to increase to B volts at maximum.

Then, when the region of the first measurement image PM on which the second measurement image PK2 is superimposed reaches the radiation position, a part of light radiated from the light emitting unit 601 is absorbed by the second measurement image PK2, and a part thereof is reflected diffusely by the region of the first measurement image PM on which the second measurement image PK2 is superimposed. When the light receiving unit 602 receives light reflected diffusely by the region of the first measurement image PM on which the second measurement image PK2 is superimposed, a voltage output from the light receiving unit 602 decreases, but does not become equal to a value lower than the threshold value Th volts. This is because the light receiving unit 602 receives light reflected diffusely from the region of the first measurement image PM on which the second measurement image PK2 is superimposed. Thereafter, when the light receiving unit 602 starts receiving light reflected diffusely from the intermediate transfer belt 6, a voltage output from the light receiving unit 602 gradually decreases, and a voltage output from the light receiving unit 602 becomes equal to A volts.

Figure 6C:
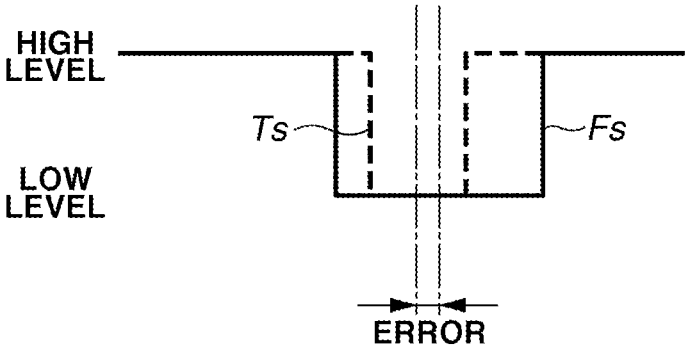

FIG. 6C illustrates a digital signal output from the comparator 603, determined according to a voltage output from the light receiving unit 602 of the optical sensor 113. If an output voltage of the light receiving unit 602 is equal to or higher than the threshold value Th, a low level signal is output, and if an output voltage of the light receiving unit 602 is lower than the threshold value Th, a high level signal is output. A broken line Ts indicates a signal output from the comparator 603, in a case where an amount of diffusely reflected light from the second measurement images PK1 and PK2 received by the light receiving unit 602 is equal to or greater than a target value. Further, a solid line Fs indicates a signal output from the comparator 603, in a case where an amount of diffusely reflected light from the second measurement image PK1 and PK2 received by the light receiving unit 602 is lower than the target value.

A center position of a time period during which a signal Ts output from the comparator 603 becomes a low level in a case where the black toner is not deteriorated, differs from a center position of a time period during which a signal Fs output from the comparator 603 becomes a low level in a case where the black toner is deteriorated. Accordingly, an error occurs between a position of the composite measurement pattern determined according to an output signal Fs in a case where the black toner is deteriorated, and a position of the composite measurement pattern determined according to an output signal Is in a case where the black toner is not deteriorated. Consequently, the CPU 70 erroneously detects a position at which the black image is formed, determined according to an output signal (solid line Fs), in a case where an amount of diffusely reflected light from the second measurement image PK1 and PK2 is less than the target value.

Thus, in the present exemplary embodiment, there is employed a configuration for varying the threshold value Th for the comparator 603 to binarize a voltage output from the light receiving unit 602 to output a high-level signal and a low-level signal, depending on a length of the measurement time period during which the voltage output from the light receiving unit 602 becomes equal to or higher than the threshold value Th.

Figure 7:
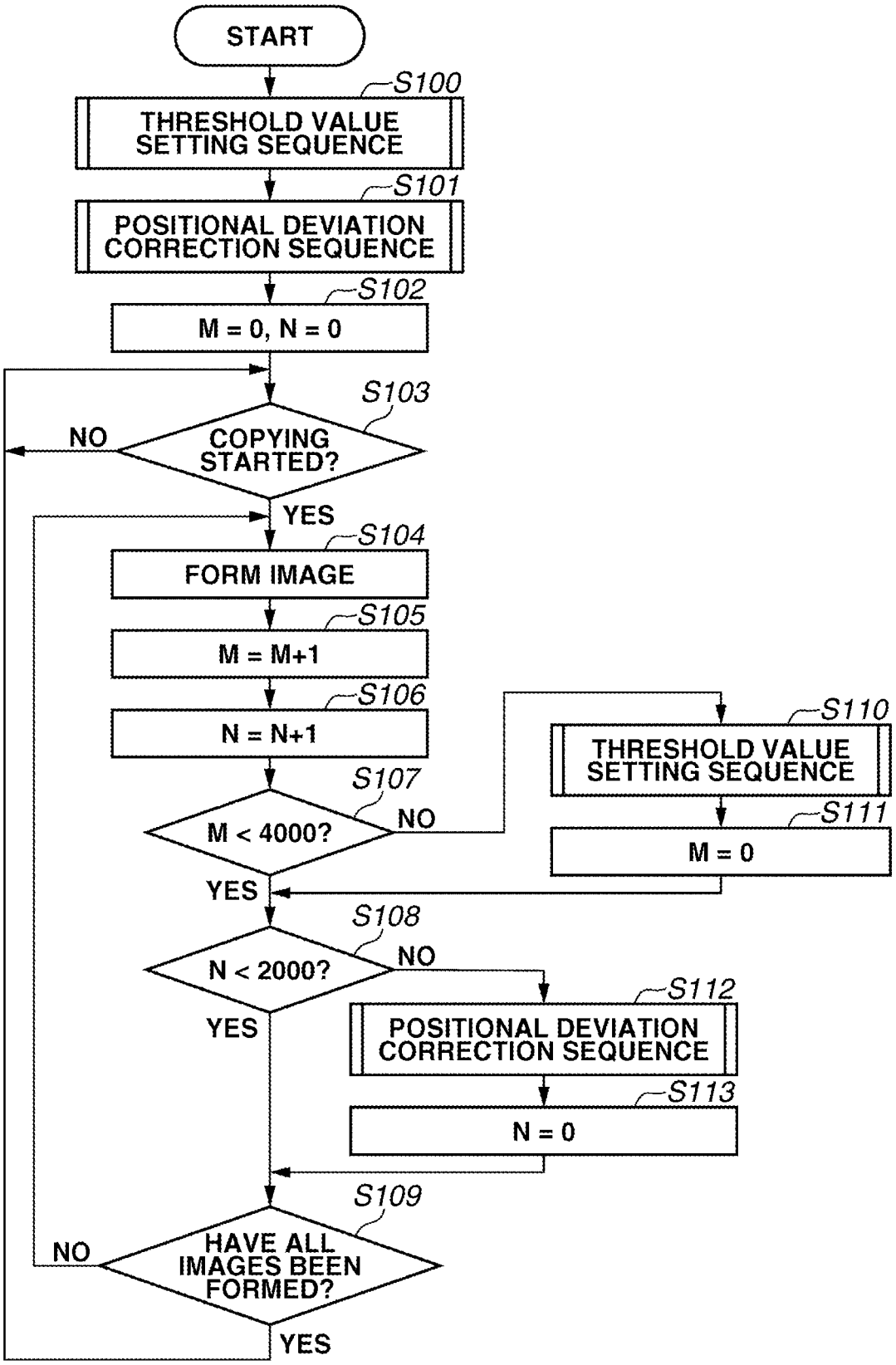
FIG. 7 is a flowchart illustrating processing for forming images by the image forming apparatus.

FIG. 7 is a flowchart illustrating an operation of the CPU 70 illustrated in FIG. 3 when the image forming apparatus according to the present exemplary embodiment forms an image. The processing in the flowchart of FIG. 7 is executed by the CPU 70 illustrated in FIG. 3 reading a program stored in the ROM 73 illustrated in FIG. 3.

First, in step S100, the CPU 70 executes threshold value setting sequence, when a main power source of the image forming apparatus is turned on. In step S101, the CPU 70 executes positional deviation correction sequence. The positional deviation correction sequence corresponds to a measurement mode. After that, in step S102, the CPU 70 resets a first copy counter M, and a second copy counter N to 0. The threshold value setting sequence in step S100 will be described below with reference to FIG. 8, and the positional deviation correction sequence in step S101 will be described below with reference to FIG. 10.

Then, the CPU 70 stands by until a signal to start copying is input (NO in step S103). If image data is input from an external apparatus such as a PC via the interface 74 (YES in step S103), in step S104, an image is formed based on the image data. When an image for one page is formed by the image forming units StY, StM, StC, and StK in step S104, in step S105, the CPU 70 increments a first copy counter M by 1, then in step S106, increments a second copy counter N by 1.

Then, in step S107, the CPU 70 determines whether the value of the first copy counter M is less than 4000. In step S107, if the value of the first copy counter M is less than 4000 (YES in step S107), in step S108, the CPU 70 determines whether the value of the second copy counter N is less than 2000. In step S108, if the value of the second copy counter N is less than 2000 (YES in step S108), in step S109, the CPU 70 determines whether all images corresponding to the input image data have been formed. In step S109, if all images corresponding to the input image data have not been formed (NO in step S109), the CPU 70 returns to step S104.

On the other hand, in step S109, if all images corresponding to the input image data have been formed (YES in step S109), the processing returns to step S103, and stands by until a signal to start copying is input.

Further, in step S107, if the value of the first copy counter M is equal to or greater than 4000 (NO in step S107), in step S110, the CPU 70 executes the threshold value setting sequence. Then, in step S111, the CPU 70 resets the value of the first copy counter M to 0. After that, the processing proceeds to step S108. In the present exemplary embodiment, there has been employed a configuration in which the CPU 70 executes the threshold value setting sequence each time images for 4000 pages are formed by the image forming units StY, StM, StC, and StK. However, the timing when executing the threshold value setting sequence is not limited to every 4000 pages. For example, when the surface of the intermediate transfer belt 6 has become rough by forming a plurality of images, an amount of light reflected diffusely by the intermediate transfer belt 6 increases. Accordingly, the amount of diffusely reflected light from the intermediate transfer belt 6 received by the light receiving unit 602 increases, and the voltage output from the light receiving unit 602 is likely to become equal to or greater than the threshold value Th. Therefore, it is only necessary to employ a configuration in which the threshold value setting sequence is executed before it is estimated that the amount of light reflected diffusely from the surface of the intermediate transfer belt 6 may exceed the threshold value Th, and it is only necessary to set as appropriate the number of pages for automatically executing the threshold value setting sequence. Alternatively, a configuration may be employed in which the threshold value setting sequence is executed by inputting a signal for executing the threshold value setting sequence into the CPU 70 from the operation panel 71, by the user performing a predetermined operation using the operation panel 71. The processing performed in step S110, since it is the same as that performed in step S100 described above, will be described in more detail using the threshold value correction sequence illustrated in FIG. 8 described below.

On the other hand, in step S108, if the value of the second copy counter N is equal to or greater than 2000 (NO in step S108), in step S112, the CPU 70 executes the positional deviation correction sequence. In step S113, the CPU 70 resets the value of the second copy counter N to 0. After that, the processing proceeds to step S109. The positional deviation correction sequence in step S112 is the same as the positional deviation correction sequence in step S101. In the present exemplary embodiment, there has been employed a configuration in which the CPU 70 executes the positional deviation correction sequence each time images for 2000 pages are formed by the image forming units StY, StM, StC, and StK. However, the timing when executing the positional deviation correction sequence is not limited to every 2000 pages. For example, when images for a certain number of pages are formed, relative positional relationship of the toner images transferred onto the intermediate transfer belt 6 seems to be deviated for each of the image forming units StY, StM, StC, and StK by the heat of the fixing device 10. Then it is only necessary to employ a configuration in which the positional deviation correction sequence is automatically executed each time the images for the above certain number of pages are formed. For this reason, it is only necessary to set as appropriate the number of pages that prescribes the timing for executing the positional deviation correction sequence. Alternatively, a configuration may be employed in which the positional deviation correction sequence is executed in response to the fact that a sensor (not illustrated) detects that temperature or humidity of the image forming apparatus has changed to equal to or greater than a predetermined value. Alternatively, a configuration may be employed in which the positional deviation correction sequence is executed by inputting a signal for executing the positional deviation correction sequence into the CPU 70 from the operation panel 71, by the user performing a predetermined operation using the operation panel 71. The processing performed in Step S112 is the same as that performed in step S101 described above, and therefore the processing in step S112 will be described in more detail in the positional deviation correction sequence illustrated in FIG. 10 described below.

Next, the threshold value setting sequence executed in steps S100 and S110 in FIG. 7 will be described with reference to the flowchart illustrated in FIG. 8. The processing in Step S110 is similar to that in step S100, and therefore description thereof will not be repeated. Further, the processing of the flowchart is executed by the CPU 70 to read a program stored in the ROM 73.

When the threshold value setting sequence starts, first, in step S200, the CPU 70 resets a retry counter to 0, and resets a detection counter C to 0. After that, in step S201, the CPU 70 drives the motor 78 to rotate. In step S201, when the motor 78 is driven to rotate, the intermediate transfer belt 6 starts circulating.

Then, in step S203, the CPU 70 turns on the light emitting unit 601, and in step S204, detects an output voltage determined according to an amount of diffusely reflected light from the intermediate transfer belt 6, for one round of the intermediate transfer belt 6. In step S204, the CPU 70 stores in the RAM 72 voltage values output from the light receiving unit 602 at a predetermined time interval while the intermediate transfer belt 6 circulates one round. Then, in step S205, the CPU 70 calculates an average value of the output voltages (hereinafter, referred to as average voltage $V_{ave}$) detected for one round of the intermediate transfer belt 6 detected in step S204. In step S205, the CPU 70 acquires a plurality of output voltages according to an amount of light reflected from the intermediate transfer belt 6, and calculates an average value of the plurality of output voltages.

Then, in step S206, the CPU 70 forms the measurement images 301,302, and 303 on the intermediate transfer belt 6 using the image forming units StY, StM, and StC. In step S206, only the measurement image 301 of yellow, the measurement image 302 of magenta, and the measurement image 303 of cyan are formed on the intermediate transfer belt 6. This is to set the threshold value Th for detecting that the measurement image 301 of yellow, the measurement image 302 of magenta, and the measurement image 303 of cyan each have passed through the radiation position.

Then, in step S207, the CPU 70 determines whether the measurement images 301, 302, and 303 have passed through the radiation position on the intermediate transfer belt 6. If a time required since the measurement images 301, 302, and 303 are formed on the intermediate transfer belt 6 until these measurement images 301, 302, and 303 finish passing through the radiation position, has elapsed, the CPU 70 determines that the measurement images 301, 302, and 303 have passed through the radiation position. At that time, the CPU 70 detects a plurality of voltages output from the light receiving unit 602, during a time period in which it is expected that each of the measurement images 301, 302, and 303 passes through the radiation position, and identifies a maximum output voltage for each of the measurement images 301, 302, and 303, of the plurality of output voltages. The CPU 70 stores the maximum output voltages in the RAM 72.

In step S207, if the measurement images 301, 302, and 303 for color misregistration detection have not passed through the radiation position (NO in step S207), in step S208, the CPU 70 determines whether the output voltage output from the light receiving unit 602 is equal to or higher than the prescribed value. If the output voltage is not equal to or higher than the prescribed value (NO in step S208), the processing proceeds to step S207. In this process, the prescribed value is set to 50% of a maximum value of the voltages output from the light receiving unit 602 according to the amount of diffusely reflected light from the measurement image 302 of magenta formed with a maximum density.

On the other hand, in step S208, if the output voltage is equal to or higher than the prescribed value (YES in step S208), in step S209, the CPU 70 determines whether the previous output voltage is lower than the prescribed value. The value of the output voltage of the light receiving unit 602 is stored in the RAM 72 every time. If the previous output voltage is not lowers than the prescribed value, the processing proceeds to step S207. The CPU 70 determines that, if a current output voltage is equal to or higher than the prescribed value, and the previous output voltage is also equal to or higher than the prescribed value, any one of the measurement images 301, 302, and 303 has reached the radiation position.

On the other hand, in step S209, if the previous output voltage is less than the prescribed value (YES in step S209), in step S210, the CPU 70 increments the detection counter C by 1, and the processing proceeds to step S207. If the current output voltage is equal to or higher than the prescribed value, and the previous output voltage is lower than the prescribed value, the CPU 70 determines that any one of the measurement images 301, 302, and 303 has reached the radiation position. In other words, the number of times the current output voltage is equal to or higher than the prescribed value, and the previous output voltage is lower than the prescribed value, corresponds to the number of times the measurement images 301, 302, and 303 reaches the radiation position. The CPU 70 determines whether all the measurement images 301, 302, and 303 have reached the radiation position, by repeating the processing from step S207 to step S210.

Then, in step S211, the CPU 70 determines whether the value of the detection counter C is 3. In step S211, if the value of the detection counter C is 3 (YES in step S211), the CPU 70 determines that all the measurement images 301, 302, and 303 have passed through the radiation position, and determines that output voltages from the light receiving unit 602, which receives diffusely reflected light from the respective measurement images 301, 302, and 303, have become equal to or higher than the prescribed value. Then, in step S212, the CPU 70 calculates the threshold value Th by the equation (3) described below, using a maximum value of the voltages output from the light receiving unit 602 when the respective measurement images 301, 302, and 303 pass through the radiation position, and turns off the light emitting unit 601. Accordingly, the CPU 70 terminates the threshold value setting sequence.

On the other hand, in step S211, if the value of the detection counter C is not 3 (NO in step S211), the CPU 70 determines that at least one of the voltages output by the light receiving unit 602 that has received the diffusely reflected light from the respective measurement images 301, 302, and 303 has not become equal to or greater than the prescribed value. Accordingly, the CPU 70 determines that densities of the measurement images 301, 302, and 303 decrease. In step S214, the CPU 70 determines whether the retry value of the retry counter is 1. In step S214, if a retry value of the retry counter is not 1 (NO in step S214), in step S215, the CPU 70 sets a retry value of the retry counter to 1, and resets the value of the detection counter C to 0. Then, in step S216, the CPU 70 identifies a measurement image with a valued lower than the prescribed value, and changes the image forming condition so as to increase the density of the identified measurement image. Then, the processing proceeds to step S206.

On the other hand, in step S214, if the retry value of the retry counter is 1 (YES in step S214), in step S217, the CPU 70 notifies an error by displaying that the image cannot be formed with the targeted density even when the density of the measurement image is increased, on a liquid crystal screen of the operation panel 71. Then, in step S218, the CPU 70 prohibits an execution of image formation operation, and ends the threshold value setting sequence.

Hereinbelow, a method for calculating the threshold value Th according to a maximum value of the output voltages for each of the measurement images 301, 302, and 303 will be described.

$$Th=\{(V_{ymax}+V_{mmax}+V_{cmax})/3-V_{ave}\}\times 0.05 \quad \text{(Equation 3)}$$

$V_{ymax}$; a maximum value of output voltages of the measurement image 301

$V_{mmax}$; a maximum value of output voltages of the measurement image 302

$V_{cmax}$; a maximum value of output voltages of the measurement image 303

The threshold value Th is set to 5% of a value obtained by subtracting an average value of output voltages determined according to the amount of diffusely reflected light from the intermediate transfer belt 6, from an average of maximum values of the output voltages determined according to the amounts of diffusely reflected light from the measurement images 301, 302, and 303. In the present exemplary embodiment, a voltage output from the light receiving unit 602 is offset by an average voltage $V_{ave}$ by the offset correction circuit 604 illustrated in FIG. 3.

Accordingly, since the threshold value Th is set to a value higher than the voltages output from the light receiving unit 602 that has received diffusely reflected light from the intermediate transfer belt 6, the output voltage of the light receiving unit 602 corresponding to the diffusely reflected light from the intermediate transfer belt can be prevented from becoming equal to or higher than the threshold value Th. Furthermore, since 5% of a value obtained by subtracting an average value of the output voltages determined according to the amount of diffusely reflected light from the intermediate transfer belt 6, from an average of maximum values of output voltages determined according to the amounts of diffusely reflected lights from the measurement images 301, 302, and 303 is set as the threshold value Th, positions of these measurement images 301, 302, and 303 can be detected with a high accuracy, even if densities of the respective measurement images 301, 302, and 303 have decreased. Furthermore, since the threshold value Th is set as 5% of a value obtained by subtracting an average value of the output voltages determined according to the amounts of diffusely reflected lights from the intermediate transfer belt 6, from an average of maximum values of the output voltages determined according to amounts of diffusely reflected lights from the measurement images 301, 302, and 303, erroneous detection in a case where an applied toner amount becomes uneven can be reduced.

It is known that a toner amount adhering to an measurement image becomes uneven in the conveying direction Rb due to the deterioration of developer or the influence of temperature or humidity. If the toner amount adhered to the measurement image becomes uneven in the conveying direction Rb, when the light receiving unit 602 receives a reflected light from the measurement image, the output voltage waveform of the light receiving unit 602 is distorted.

Figure 9A:
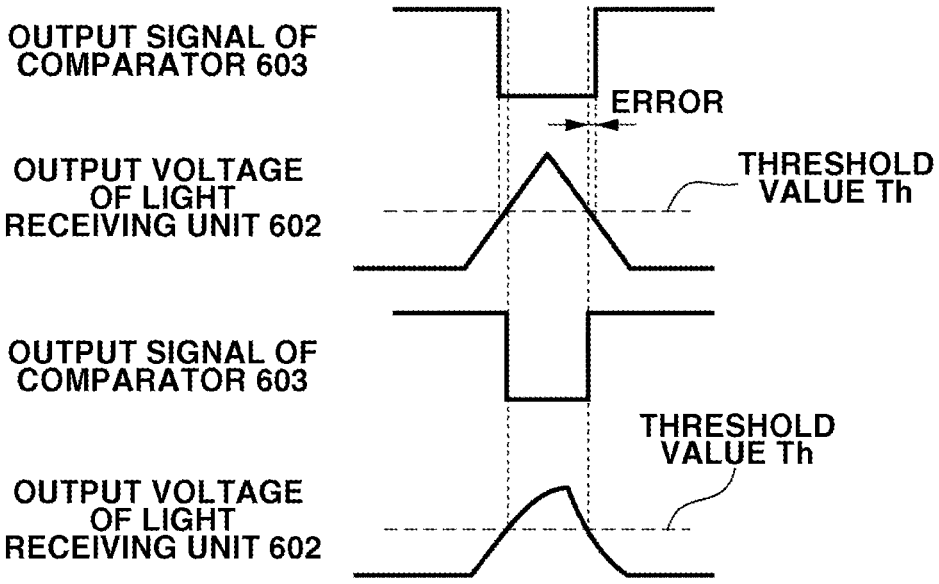
FIGS. 9A and 9B are diagrams illustrating comparatively digital signals output from a comparator with a different threshold value.
Figure 9B:
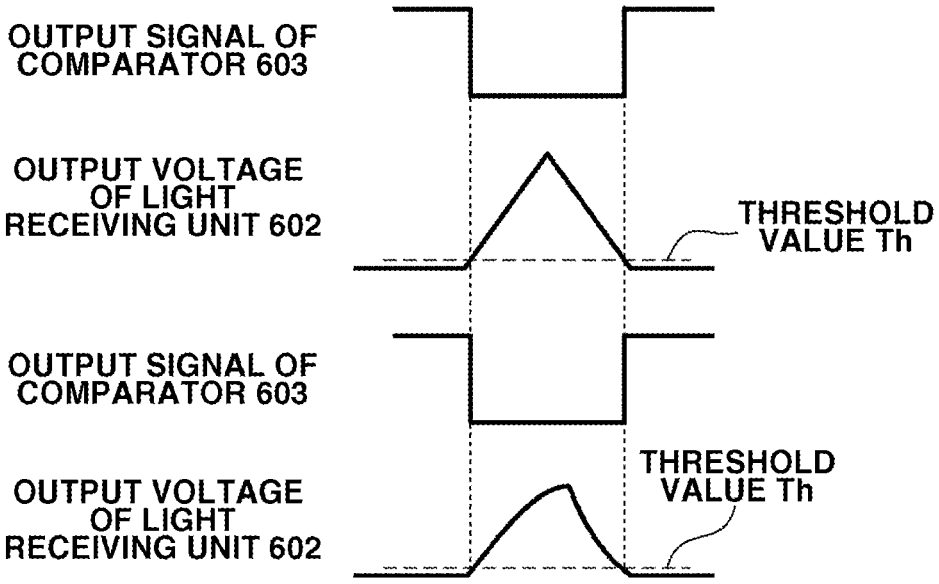

FIGS. 9A and 9B are comparison diagrams comparing waveforms of signals output from the comparator 603, when the waveforms of the voltages output from the light receiving unit 602 are distorted in a state where the threshold value Th is set to different values. The threshold value Th in FIG. 9A has been set to 50% of a maximum value of the voltages output from the light receiving unit 602 determined according to the amounts of diffusely reflected light from the measurement image 302 of magenta formed with the maximum density. The threshold value Th in FIG. 9B has been set to 5% of the maximum value of the voltages output from the light receiving unit 602 determined according to the amounts of diffusely reflected light from the measurement image 302 of magenta formed with the maximum density. In a case where output voltage waveforms of the light receiving unit 602 are distorted, error occurs between a forming position of the measurement image determined in a case where the threshold value Th is set to 50% of the maximum value of the output voltages, and a forming position of the measurement image determined in a case where the threshold value Th is set to 5% of the maximum value of the output voltages. Therefore, it is necessary to set the threshold value Th to a value at which the CPU 70 does not erroneously detect the forming position of the measurement image which would make the output voltage waveforms of the light receiving unit 602 to be distorted. Thus, in the present exemplary embodiment, the threshold value Th has been set to 5% of the maximum value of the output voltages.

Figure 10:
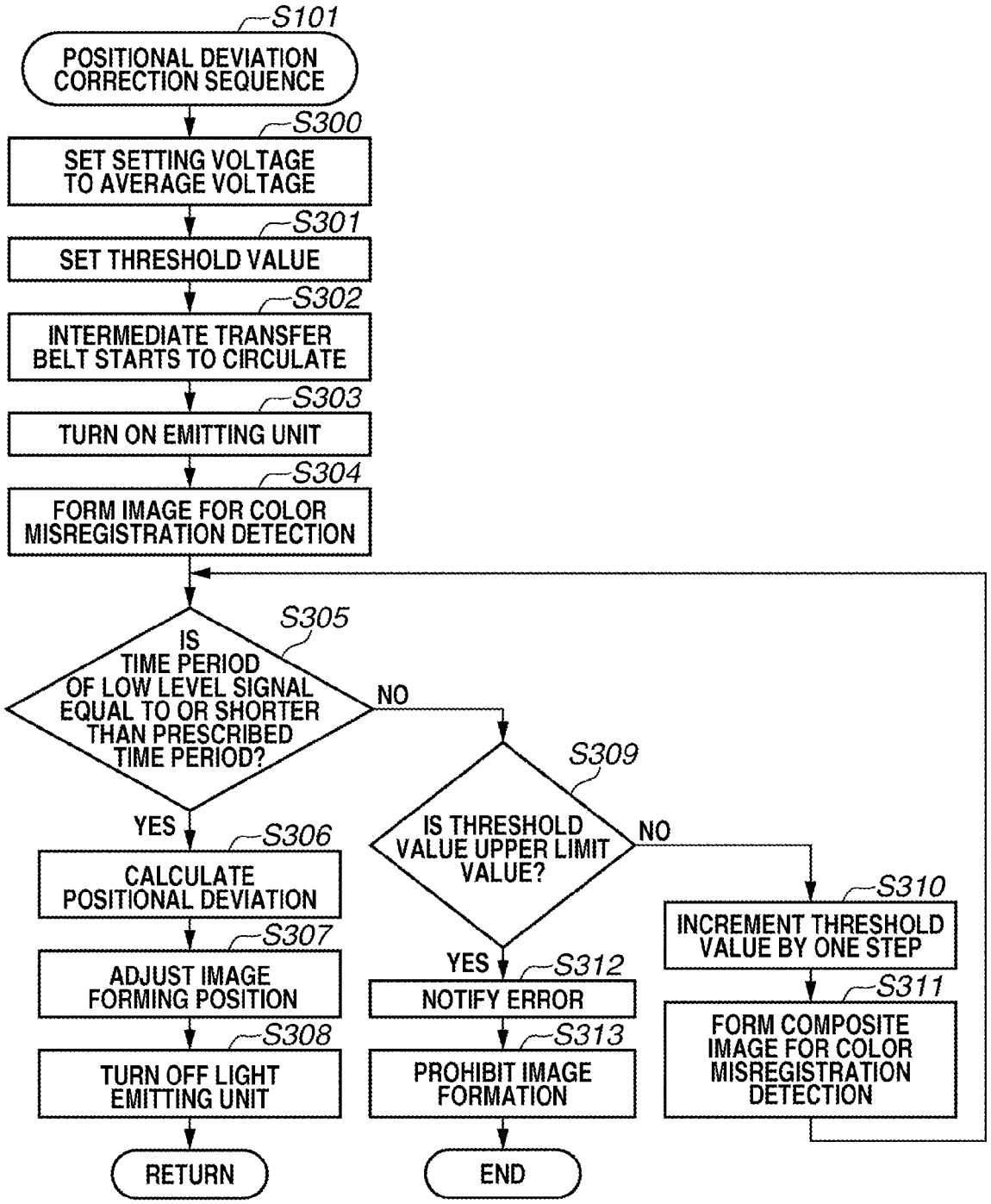
FIG. 10 is a flowchart illustrating a positional deviation correction sequence.
Figure 11:
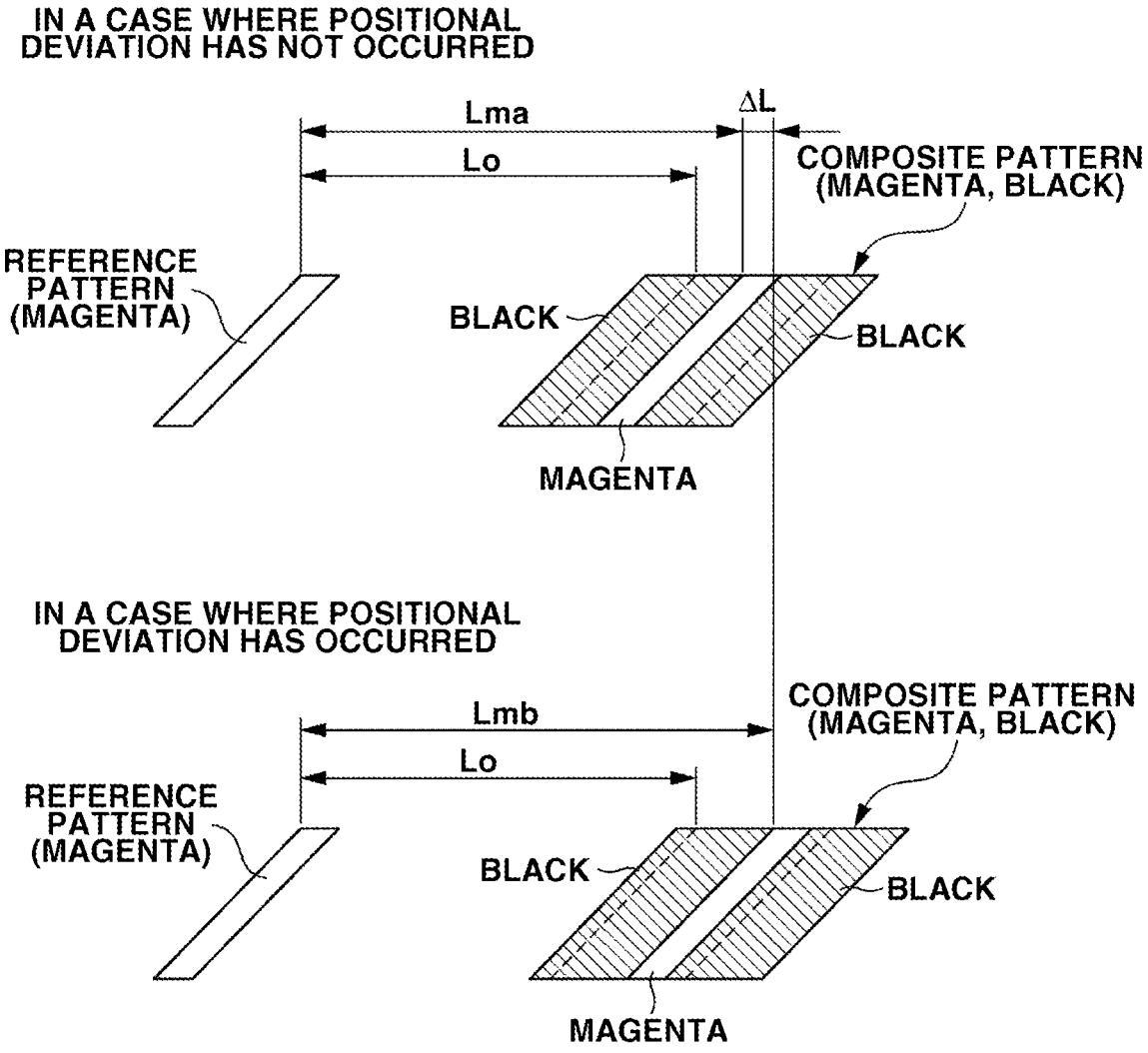
FIG.11 PRIOR ART
FIG. 11 is a diagram illustrating a reference pattern and a composite pattern.

Next, the positional deviation correction sequence executed in steps S101 and S112 in FIG. 7 will be described with reference to the flowchart in FIG. 10. The processing performed in step S112 is similar to that performed in step S101, and therefore description thereof will not be repeated. Further, the processing performed in the flowchart is executed by the CPU 70 reading a program stored in the ROM 73.

When the positional deviation correction sequence is executed, first, in step S300, the CPU 70 sets a setting voltage of the offset correction circuit to the average voltage $V_{ave}$ calculated in the threshold value setting sequence described above. The setting voltage is set in step S300, and thereby a voltage of difference between a voltage output from the light receiving unit 602 and the average voltage $V_{ave}$ is input into the comparator 603.

Then, in step S301, the CPU 70 sets the threshold value Th of the comparator 603 to the threshold value Th calculated in the threshold value setting sequence. In step S302, the intermediate transfer belt 6 starts circulating by driving to rotate the motor 78. Then, in step S303, the CPU 70 turns on the light emitting unit 601. In step S304, the CPU 70 forms the measurement images 301, 302, and 303 and the composite measurement image 304 illustrated in FIG. 4 on the intermediate transfer belt 6, using the image forming units StY, StM, StC, and StK. In this process, the measurement image 302 corresponds to the reference image, and the composite measurement image 304 corresponds to the measurement image.

The positional deviation corrections of yellow, magenta, and cyan are performed using a publicly known conventional method, and therefore, in the following descriptions of steps S305 to S313, only the positional deviation correction of black will be described.

In step S305, the CPU 70 determines whether a time period of a low level signal output from the comparator 603 is equal to or shorter than the prescribed time period. The prescribed time period is determined by a time taken until the gap between the second measurement images PK1 and PK2 of the composite measurement image 304 has passed through the radiation position of the light emitting unit 601.

If the time period of the low level signal output from the comparator 603 is equal to or shorter than the prescribed time period, the CPU 70 determines that it can detect a forming position of the black images on the intermediate transfer belt 6. In step S305, if the time period of the low level signal is equal to or shorter than the prescribed time period (YES in step S305), in step S306, the CPU 70 calculates positional deviation amounts ΔV and ΔH of the composite measurement image 304 relative to the reference image 302, using the above-described equation 1 and equation 2. Then, in step S307, the CPU 70 adjusts the position at which the image forming unit StK forms an image, based on the positional deviation amounts ΔV and ΔH of the composite measurement image 304 calculated in step S306. In step S308, the CPU 70 turns off the light emitting unit 601.

Further, if the above-described time period of the low level signal is longer than the prescribed time period, diffusely reflected light from the region of the first measurement image PM covered by the second measurement images PK1 and PK2 is received by the light receiving unit 602, and thereby the voltage output from the light receiving unit 602 has becomes equal to or higher than the threshold value Th. Accordingly, if the time period of the low level signal is longer than the prescribed time period, the CPU 70 determines that it cannot detect the position of the black image on the intermediate transfer belt 6.

In step S305, if a time period of the low level signal output from the comparator 603 is longer than the prescribed time period (NO in step S305), in step S309, the CPU 70 determines whether the threshold value Th currently set is the upper limit value of settable threshold values. In the present exemplary embodiment, the threshold value Th can be lifted to four steps of 2 times, 3 times, 4 times, and 5 times of the threshold value Th set in step S301. In step S309, if the threshold value Th currently set is not an upper limit value (5 times) of settable threshold values (NO in step S309), in step S310, the CPU 70 increments the threshold value Th by one step. Then, in step S311, the CPU 70 forms the composite measurement image 304, using the image forming units StM and StK, and the processing proceeds to step S305. By repeating the processing from step S305 to step S311, the CPU 70 can identify the threshold value Th for detecting the forming position of the composite measurement image 304.

On the other hand, in step S309, if the threshold value Th currently set is the upper limit value of settable threshold values Th (YES in step S309), in step S312, the CPU 70 displays a message that the positional deviation cannot be corrected, on the liquid crystal screen of the touch panel of the operation panel 71. That is, in step S312, the operation panel 71 works as a notification unit that notifies the user of an error. If a time period during which a reflected light amount from the light receiving unit 602 becomes equal to or greater than the upper limit value of the threshold values is longer than the prescribed time period, it means that there is an abnormal state that the black toner is remarkably deteriorated, or the composite measurement image 304 cannot pass through the position at which the measurement light is radiated.

Then, in step S313, the CPU 70 prohibits the execution of the image forming operation, and ends the positional deviation correction sequence. In step S313, the CPU 70 works as a prohibition unit that prohibits execution of the image forming operation.

Further, in the present exemplary embodiment, there is employed a configuration for forming the composite measurement image 304 for detecting the position at which the black image is formed by forming the black image on the magenta image, but yellow or cyan image may be formed in place of magenta. In other words, it is only necessary to form the composite measurement image 304 by superimposing an image formed using achromatic color toner, on an image formed using chromatic color toner.

Alternatively, there may be employed a configuration for forming a composite measurement image for color misregistration detection using a toner other than black, and a toner having a higher reflectance than the toner in order to detect a position at which an image other than black is formed. Specifically, there may be employed a configuration for forming the composite measurement image 304, by superimposing a second measurement image formed using the cyan toner having a lower reflectance than the yellow toner on a first measurement image formed using the yellow toner, in order to detect a position at which the cyan image is formed.

In the present exemplary embodiment, there is employed a configuration for adjusting positions at which yellow, cyan, and black images are formed, using the position at which the magenta image is formed on the intermediate transfer belt 6 as a reference, but a position at which an image of color other than magenta is formed may be used as a reference. For example, there may be employed a configuration for adjusting positions at which magenta, cyan, and black images are formed, using a position at which the yellow image is formed on the intermediate transfer belt 6 as a reference. In a case where this configuration is employed, it is only necessary to adjust positions at which the magenta, cyan, and black images are formed, based on a result of detected forming positions of the images 301, 302, and 303 for color misregistration detection and the composite image 304 for color misregistration detection.

According to the present exemplary embodiment, color misregistration can be prevented even if toner is deteriorated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

a first image forming unit configured to form a first image by using toner of a first color;

a second image forming unit configured to form a second image by using toner of a second color having lower reflection ratio than the first color;

an image bearing member to which the first image and the second image are transferred;

a controller configured to control the first image forming unit and the second image forming unit to form a measurement image on the image bearing member, wherein the measurement image includes a first pattern formed by the first image forming unit and a second pattern formed by the second image forming unit, and wherein the second pattern is superimposed on the first pattern, an irradiation unit configured to irradiate the measurement image with light, a light receiving unit configured to receive reflected light from the measurement image and output a signal value corresponding to the reflected light being received;

a determination unit configured to compare the signal value output from the light receiving unit and a threshold value and determine information of positional relation between the first image and the second image based on the comparison result;

a correction unit configured to correct a color misregistration between the first image and the second image based on the positional relation; and an adjustment unit configured to adjust the threshold value by comparing the signal value of the measurement image output from the light receiving unit and the threshold value; and wherein the adjustment unit adjusts the threshold value so that an amount of reflected light from the second pattern of the measurement image is less than an amount of reflected light corresponding to the threshold value.

2. The image forming apparatus according to claim 1, wherein, in a case where the adjustment unit adjusted the threshold value, the controller controls the first image forming unit and the second image forming unit to form the measurement image newly.

3. The image forming apparatus according to claim 1, wherein, in a case where a time period during which the signal value output from the light receiving unit is higher than the threshold value is longer than a predetermined time period, the adjustment unit increases the threshold value.

4. The image forming apparatus according to claim 3, wherein the adjustment unit increases the threshold value so that the time period to be less than the predetermined time period.

5. The image forming apparatus according to claim 4, wherein the image bearing member conveys the measurement image, wherein the second pattern includes a gap, wherein the first pattern appears in the gap of the second pattern, and wherein the predetermined time period corresponds to a length of the gap in a conveyance direction of the image bearing member.

6. The image forming apparatus according to claim 1, wherein the controller controls the first image forming unit to form another measurement image on the image bearing member, wherein, in a case where the light receiving unit received reflected light from said another measurement image, the light receiving unit outputs another signal value corresponding to the reflected light from said another measurement image, and wherein the determination unit compares the signal value output from the light receiving unit, said another signal value output from the light receiving unit and the threshold value, and determines the information based on the comparison result.

7. The image forming apparatus according to claim 1, wherein the comparison result represents a first timing that the signal value changes from a first value to a second value, and a second timing that the signal value changes from the second value to the first value, and wherein the first value is lower than the threshold value, and wherein the second value is higher than the threshold value, and wherein the determination unit determines the information based on the first timing and the second timing.

8. The image forming apparatus according to claim 1, further comprising:

a setting unit configured to set the threshold value based on a signal value output from the light receiving unit in a case where the light receiving unit receives reflected light from a region where the measurement image is not formed, wherein the adjustment unit adjusts the threshold value being set by comparing the signal value of the measurement image output from the light receiving unit and the threshold value set by the setting unit.

9. The image forming apparatus according to claim 8, wherein the region includes a plurality of positions of the image bearing member, and wherein the setting unit sets the threshold value based on a plurality of signal values output from the light receiving unit in a case where the light receiving unit receives reflected light from the region.

10. The image forming apparatus according to claim 9, wherein the setting unit sets the threshold value based on an average of the plurality of signal values.

11. The image forming apparatus according to claim 1, further comprising:

a notification unit configured to notify that the determination unit cannot determine the information, in a case where an amount of reflected light from the second pattern of the measurement image is not less than an amount of reflected light corresponding to the threshold value after the threshold value is adjusted by the adjustment unit.

12. The image forming apparatus according to claim 1, further comprising:

a notification unit configured to notify an abnormity of the second image forming unit, in a case where an amount of reflected light from the second pattern of the measurement image is not less than an amount of reflected light corresponding to the threshold value after the threshold value is adjusted by the adjustment unit.

13. The image forming apparatus according to claim 1, further comprising:

a prohibition unit configured to prohibit the second image forming unit from forming the second image, in a case where an amount of reflected light from the second pattern of the measurement image is not less than an amount of reflected light corresponding to the threshold value after the threshold value is adjusted by the adjustment unit.

14. The image forming apparatus according to claim 3, further comprising:

a notification unit configured to notify that the determination unit cannot determine the information, in a case where the time period is longer than a predetermined time period after the threshold value is adjusted by the adjustment unit.

15. The image forming apparatus according to claim 3, further comprising:

a notification unit configured to notify an abnormity of the second image forming unit, in a case where the time period is longer than a predetermined time period after the threshold value is adjusted by the adjustment unit.

16. The image forming apparatus according to claim 3, further comprising:

a prohibition unit configured to prohibit the second image forming unit from forming the second image, in a case where the time period is longer than a predetermined time period after the threshold value is adjusted by the adjustment unit.

17. The image forming apparatus according to claim 1, wherein the light receiving unit receives diffusely reflected lights from the measurement image.

18. The image forming apparatus according to claim 1, wherein the first color is a chromatic color, and wherein the second color is achromatic color.

* * * * *